United States Patent [19]

Witting

[11] Patent Number: 4,894,590

[45] Date of Patent: Jan. 16, 1990

[54] SPIRAL SINGLE STARTING ELECTRODE FOR HID LAMPS

[75] Inventor: Harald L. Witting, Burnt Hills, N.Y.

[73] Assignee: General Electric Company, Schenectady, N.Y.

[21] Appl. No.: 226,584

[22] Filed: Aug. 1, 1988

[51] Int. Cl.[4] ..... H05B 41/24

[52] U.S. Cl. ..... 315/248; 313/146; 313/151; 313/153

[58] Field of Search ..... 315/248, 236, 267, 344, 315/357, 111.51, 39; 313/152, 151, 146, 153, 234, 574, 607

[56] References Cited

U.S. PATENT DOCUMENTS 4,812,702 3/1989 Anderson ..... 315/344 X

*Primary Examiner*—David Mis

*Attorney, Agent, or Firm*—Geoffrey H. Krauss; James C. Davis, Jr.; Marvin Snyder

[57] ABSTRACT

A single starting electrode is provided for an electrodeless high-intensity-discharge lamp arc of the type having an arc tube situated within the bore of an excitation coil and in the interior of which arc tube is to be provided a plasma arc discharge driven by the excitation coil. The starting electrode is a conductive conical spiral having a narrower end disposed adjacent to one of the arc tube surfaces. A high voltage is formed by induction, as the spiral electrode receives an RF magnetic flux, to cause an electric field to be produced sufficient to create a glow discharge in the arc tube, and cause a rapid transition to a high-current solenoidal discharge to form the discharge plasma responsive to the normal field provided by the excitation coil.

9 Claims, 1 Drawing Sheet

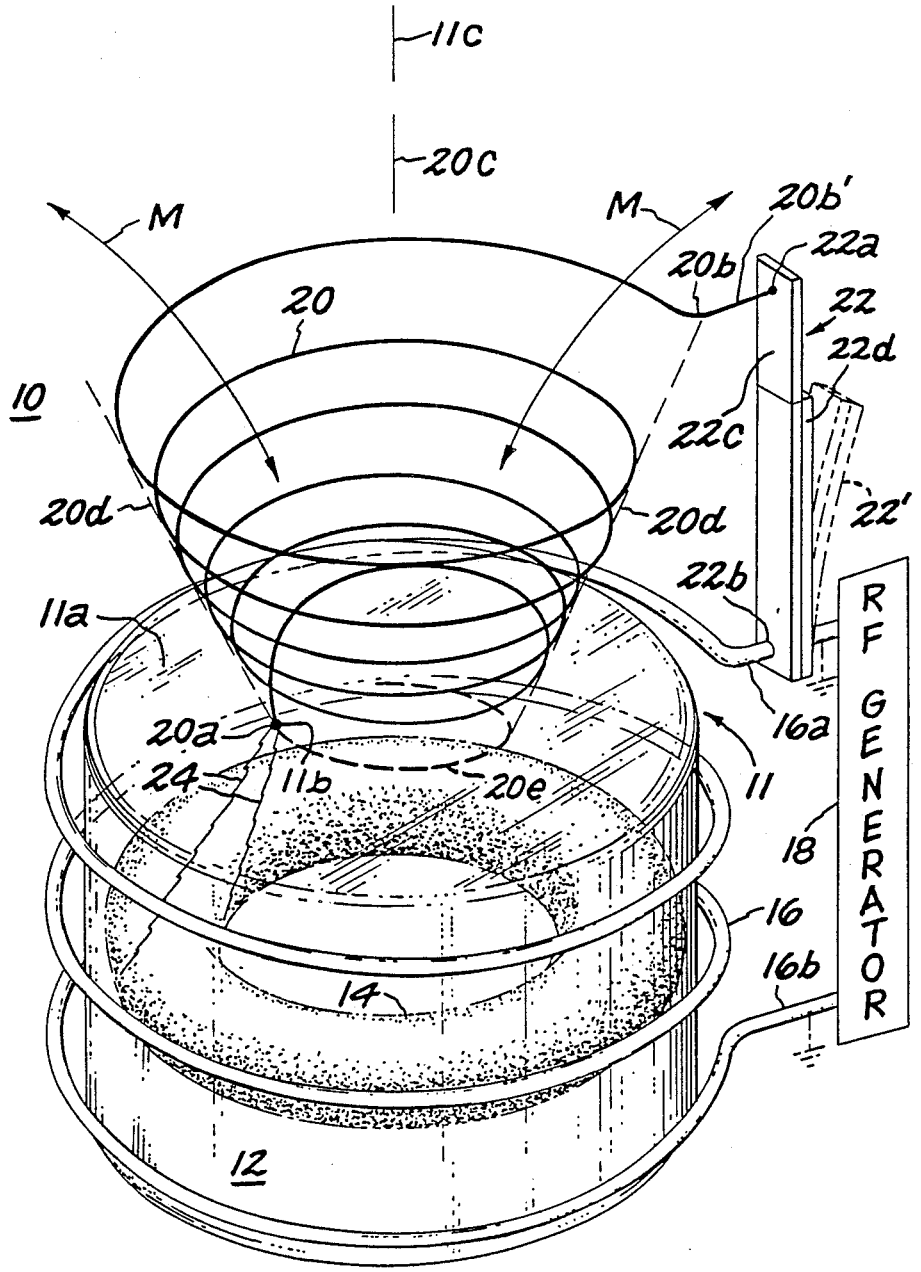
11c
20c
M
M
20b'
20b
22a
22
22d
20
10
22c
20d
20d
22'
22b
11a
RF GENERATOR
16a
20a
24
11b
20e
11
18
16
16b
14
12

SPIRAL SINGLE STARTING ELECTRODE FOR HID LAMPS

BACKGROUND OF THE INVENTION

The present invention relates to electrodeless high-intensity-discharge (HID) lamps and, more particularly, to a novel conical-spiral single electrode for initiating a plasma discharge within the arc space of the electrodeless HID lamp.

It is now well known to provide a toroidal light-emitting plasma within the envelopes of a HID lamp. The induction arc plasma depends upon a solenoidal, divergence-free electric field for its maintenance; the field is created by the changing magnetic field of an excitation coil, which is typically in the form of a solenoid. It is necessary to develop a very high electric field gradient across the arc tube to start the plasma discharge; it is difficult to develop a sufficiently high electric field gradient, especially in the associated excitation coil, because the coil current may be prohibitively high, even if it is to be provided only on a pulse basis. Further, providing a very high electric field gradient may be impossible because the necessary field-per-turn of the excitation coil may exceed the turn-to-turn electrical breakdown rating of that coil. Thus, it is difficult to provide some means for starting induction-driven HID lamps, and it is also difficult to provide for hot restarting of the same type of lamp. It is therefore highly desirable to provide some means for starting the HID lamp plasma discharge, which starting means can be easily utilized with typical HID lamps, under normal ambient conditions. Capacitive electrode pairs for aiding the starting process are described and claimed in copending U.S. application Ser. No. 208,514, 225,315 and now-allowed 229,187, respectively, filed June 20, 1988, July 28, 1988 and Aug. 8, 1988, all assigned to the assignee of the present invention and all incorporated herein by reference in their entireties.

BRIEF SUMMARY OF THE INVENTION

In accordance with the invention, an electrodeless high-intensity-discharge lamp, having an arc tube situated within the bore of an excitation coil and in the interior of which arc tube is to be provided a plasma arc discharge driven by the excitation coil, is provided with a single conical-spiral-shaped starting electrode having its narrower end disposed adjacent to, or on, an associated arc tube surface, and having its wider end positioned such that the RF flux generated by the excitation coil cuts the turns of the spiral electrode to generate a high-voltage signal and causes an electric field to be produced within the arc tube, near the end of the spiral electrode, with magnitude and position sufficient to cause the material within the lamp to create a glow discharge in the arc tube, due to the arc tube wall capacitance. The glow discharge creates enough ionization in a suitable location so that a rapid transition to a high-current solenoidal discharge will occur and form the discharge plasma responsive to the normal field provided by the excitation coil.

In a presently preferred embodiment, the axis of the single spiral starting electrode is substantially aligned with the tube axis. Means, such as a bimetallic strip, for moving the starting electrode away from the discharge tube, responsive to receipt of a stimulus, such as thermal energy released from the tube, can be utilized to extend the discharge tube useful life.

Accordingly, it is an object of the present invention to provide a novel single spiral-shaped starting electrode for an electrodeless high-intensity-discharge lamp.

This and other objects of the invention will become apparent upon reading the following detailed description, when considered in conjunction with the single drawing FIGURE.

BRIEF DESCRIPTION OF THE PREFERRED EMBODIMENT

The single FIGURE is a prospective view of an arc tube and excitation coil of a HID lamp and of one presently preferred embodiment of spiral starting electrode in accordance with the present invention.

DETAILED DESCRIPTION OF THE INVENTION

Referring to the single drawing FIGURE, an induction, or electrodeless, high-intensity-discharge (HID) lamp 10 comprises an arc tube, or envelope, 11 having a substantially cylindrical shape, enclosing a substantially gaseous material 12 including a starting gas, such as argon, xenon, krypton and the like, and a metal halide, such as sodium iodide, cerium iodide and the like. A substantially toroidal arc discharge 14 is to be generated and then maintained within envelope 11 by an electric field generated by an excitation coil 16, responsive to a radio-frequency (RF) signal applied between the opposite coil ends **16*a* and 16*b* by a RF generator means 18. Envelope 11 is positioned with its axis 11*c* generally along the axis of coil 16**.

In accordance with one aspect of the invention, a starting electrode 20 is provided as a generally conically-spiral-shaped conductive member located adjacent to the exterior of one of the top or bottom surfaces of the arc tube; illustratively, single starting electrode 20 is shown adjacent to upper arc tube surface **11*a*, and with a narrower electrode end 20*a* closely adjacent to, or even touching, a point 11*b* on that upper surface 11*a*. The spiral electrode 20 has an axis 20*c* extending substantially perpendicular to the adjacent surface, and thus generally parallel to the substantially-mutual axis 11*c* of envelope 11 and coil 16. An opposite, wider end 20*b* of the single spiral electrode is electrically connected to some portion of the coil 16, as at coil end 16*a*, and is mechanically supported and held in position by a conductive support means 22. That is, a radial extension 20*b*' of the spiral electrode is held in an aperture 22*a* of the support means 22, which has a second aperture 22*b* through which an adjacent coil end 16*a* extends, to hold the starting aid above arc tube 11. The magnetic flux M, generated by the RF current in coil 16, cuts across the conductor of starting electrode 20 and, by induction, causes a high voltage to be applied from starting electrode 20 across the arc tube 11, forming a low-current glow discharge region 24 as current flows through the arc tube and back to the excitation coil. The glow discharge volume 24 generates enough ionization, in a very favorable location with respect to the desired discharge plasma toroid 14, so that transition to the high-current plasma arc discharge rapidly occurs. Even more favorable glow discharge is provided by forming an arcuate extension 20*e* from the narrower spiral end 20*a*. The extension 20*e* lies in a plane parallel to, and typically abutting, the upper tube surface 11*a* and generally follows the centerline of torus 14 over at least one-quarter of a circle but less than a full circle. It should be noted that the spiral starting electrode 20 is not physically connected to a separate power supply, but is inductively coupled to the excitation coil 16** for formation of the high voltage starting signal; a second starting electrode is not needed.

It will be seen that the starting electrode need be positioned near arc tube 11 only during the starting process. It will also be seen that a stationary spiral single starting electrode 20 has several disadvantages: being in close proximity to arc tube 11, starting electrode 20 interferes with temperature control of the arc tube and blocks light emission therefrom; and may cause early lamp degradation due to ion bombardment of arc tube 11 from the continuous current flowing even during normal lamp operation. To alleviate the foregoing disadvantages, the presently preferred embodiment utilizes a moveable starting electrode 20. Thus, the start-aiding electrode is removed from the vicinity of arc tube 11 after the lamp has started, so that the starting aid does not: substantially block light emission; interfere with the thermal balance of arc tube 11; or contribute to lamp degradation. The support means 22 includes a conductive portion **22*c*, which is attached to a means 22*d* for bending the support member to a position shown by broken line member 22', which moves electrode 20 away from arc tube 11 once the plasma arc discharge 14 has begun. Means 22*d* can be a heat-sensitive, e.g. bimetallic, strip so formed as to be suitable straight at normal ambient temperatures, to cause starting electrode end 20*a* to lie adjacent to the lamp envelope upper surface location 11*b*. Means 22 is conductive and forms a return path for current flow from spiral electrode 20 to the lowest circuit potential, e.g. one of coil ends 16*a* or 16*b*, as shown by a common potential (ground symbol in broken line) at either (but not both) ends, or at any other desired potential. The glow discharge region 24 will thus be formed (as a spot or arcuate line, dependent upon whether extension 20*e* is used) when the coil 16 is initially energized, and will aid in starting the arc plasma discharge torus 14 within the envelope. Responsive to heat energy emitted from the operating lamp, the bimetallic strip 22*d* undergoes differential expansion and changes the curvature thereof, so that the now-curved strip 22' moves starting electrode 20 away from the arc tube. It will be understood that when the lamp is turned off, bimetallic member 22*d*** cools down and returns to the starting position.

While one presently preferred embodiment of my novel invention have been described in detail herein, it will now become apparent that many modifications and variations can be made by those skilled in the art. It is my desire, therefore to be limited only by the scope of the appending claims and not by the specific details and instrumentalities presented by way of explanation herein.

What I claim is:

1. A starting electrode for an electrodeless high-intensity-discharge (HID) lamp of the type having an arc tube situated within the bore of an excitation coil and within which arc tube a plasma arc discharge is to be formed and driven by the excitation coil, comprising:

a single starting electrode having a spiral shape and positioned, at least during commencement of the plasma arc discharge, with a narrower end adjacent to a selected point on an exterior surface of the arc tube; and means for positioning the electrode with a wider end at a selected location, to place the electrode within magnetic flux, generated by the excitation coil, sufficient to cause creation, at least at said plasma arc discharge commencement, of a glow discharge within the arc tube.

2. The starting electrode of claim 1, wherein the spiral is of conical shape.

3. The starting electrode of claim 2, wherein the spiral electrode further includes an arcuate extension lying in a plane substantially parallel to the arc tube exterior surface.

4. The starting electrode of claim 3, wherein the curve of said arcuate extension is less than a full circle and greater than a quarter-circle, and said extension substantially abuts against said surface.

5. The starting electrode of claim 2, wherein said positioning means comprises a conductive member connecting a selected portion of the electrode to an adjacent portion of the excitation coil.

6. The starting electrode of claim 5, wherein the selected portion is at the wider end of the electrode.

7. The starting electrode of claim 1, wherein said positioning means includes means, responsive to a selected stimulus, for moving the starting electrode to a location further from said arc tube than the location of the electrode during discharge commencement.

8. The starting electrode of claim 7, wherein said moving means comprises means for moving the starting electrode responsive to receipt of heat energy from said arc tube.

9. The starting electrode of claim 6, wherein said heat-energy-responsive moving means is adapted to move the starting electrode back toward the arc tube responsive to cessation of receipt of heat energy from said arc tube.

* * * * *